US009028089B2

(12) United States Patent
Kotera et al.

(10) Patent No.: US 9,028,089 B2
(45) Date of Patent: May 12, 2015

(54) ILLUMINATION DEVICE AND ILLUMINATION SYSTEM

(75) Inventors: Ryusuke Kotera, Osaka (JP); Hideharu Kawachi, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 110 days.

(21) Appl. No.: 13/560,167

(22) Filed: Jul. 27, 2012

(65) Prior Publication Data

US 2013/0051078 A1 Feb. 28, 2013

(30) Foreign Application Priority Data

Aug. 30, 2011 (JP) ..... 2011-187129

(51) Int. Cl.
*F21V 33/00* (2006.01)
*F21V 23/00* (2006.01)
*F21V 27/00* (2006.01)
(Continued)

(52) U.S. Cl.
CPC ..... *F21V 23/006* (2013.01); *F21S 2/005* (2013.01); *F21V 21/03* (2013.01); *F21V 27/00* (2013.01); *F21S 2/00* (2013.01); *F21V 21/02* (2013.01); *F21V 23/002* (2013.01); *F21V 23/06* (2013.01); *F21Y 2105/008* (2013.01)

(58) Field of Classification Search
CPC ..... F21V 27/00; F21V 23/002; F21V 23/06; F21V 23/006; F21V 21/02; F21V 33/00; F21V 21/03; F21V 21/04; F21S 2/005
USPC ..... 362/147, 653, 97.1, 97.2, 221, 94.1, 362/630–634; 248/74.3, 917; 439/131, 281, 439/282, 352–357, 43; 174/72 A; 349/58
See application file for complete search history.

(56) References Cited

U.S. PATENT DOCUMENTS 5,663,739 A * 9/1997 Pommerenke et al. ..... 345/1.3
5,949,581 A * 9/1999 Kurtenbach et al. ..... 359/621
(Continued)

FOREIGN PATENT DOCUMENTS

JP 11-007826 1/1999
JP 2007-536708 12/2007
(Continued)

OTHER PUBLICATIONS

Japanese Office Action dated Jan. 20, 2015 w/English Language Translation.

*Primary Examiner* — Elmito Breval
*Assistant Examiner* — Arman B Fallahkhair
(74) *Attorney, Agent, or Firm* — Greenblum & Bernstein, P.L.C.

(57) ABSTRACT

An illumination device includes a light source unit having a light emitting panel, and a mounting unit attached to a non-light-emission surface of the light source unit and provided with a circuit board for controlling energization of the light emitting panel. The mounting unit includes a connection terminal to which an external conductor for electrically interconnecting the circuit board and an external device is connected. The connection terminal is arranged inward of an outer peripheral end of a surface of the mounting unit to which the light source unit is attached. A clearance for passing the external conductor therethrough is formed between the light source unit and the mounting unit in a state that the external conductor is connected to the connection terminal and the mounting unit is attached to the light source unit.

14 Claims, 6 Drawing Sheets

(51) Int. Cl.

| | |
|---|---|
| ***F21V 21/02*** | (2006.01) |
| ***F21V 23/06*** | (2006.01) |
| *F21S 2/00* | (2006.01) |
| *F21V 21/03* | (2006.01) |
| *F21Y 105/00* | (2006.01) |

(56) References Cited

U.S. PATENT DOCUMENTS

| | | | | |
|---|---|---|---|---|
| 6,414,650 | B1 * | 7/2002 | Nicholson et al. | 345/1.1 |
| 6,609,804 | B2 * | 8/2003 | Nolan et al. | 362/20 |
| 6,791,513 | B2 * | 9/2004 | Ogino et al. | 345/55 |
| 7,108,392 | B2 | 9/2006 | Strip et al. | |
| 7,125,137 | B2 * | 10/2006 | Kitajima et al. | 362/153 |
| 7,232,952 | B2 * | 6/2007 | Lin et al. | 174/72 A |
| 7,542,104 | B2 * | 6/2009 | Cai et al. | 349/58 |
| 7,547,112 | B2 * | 6/2009 | Kim | 362/148 |
| 7,862,383 | B2 * | 1/2011 | Cours et al. | 439/638 |
| 7,918,562 | B2 * | 4/2011 | Matsumoto et al. | 353/31 |
| 7,918,565 | B2 * | 4/2011 | Hemphill et al. | 353/78 |
| 7,965,257 | B2 * | 6/2011 | Perkins et al. | 345/1.3 |
| 2008/0037284 | A1 * | 2/2008 | Rudisill | 362/629 |
| 2011/0149197 | A1 | 6/2011 | Fukuda | |

FOREIGN PATENT DOCUMENTS

| | | |
|---|---|---|
| JP | 2009-198631 | 9/2009 |
| JP | 2011-134467 | 7/2011 |

* cited by examiner

ILLUMINATION DEVICE AND ILLUMINATION SYSTEM

FIELD OF THE INVENTION

The present invention relates to an illumination device in which a light emitting panel is used as a light source and an illumination system using the same.

BACKGROUND OF THE INVENTION

In the past, there is known an illumination system including a plurality of tile-shaped flat light emitting units (hereinafter referred to as "light emitting units"). In this illumination system, the light emitting units are arranged in a grid shape to adjoin to one another. The adjoining light emitting units are electrically connected to each other through contact points arranged in the mutually adjoining edges of the light emitting units. Electric power is fed from one of the light emitting units to the other via the contact points (see, e.g., Japanese Application Publication No. 2007-536708).

In the light emitting units of this kind, an external conductor such as a lead wire or the like is used to electrically interconnect the adjoining light emitting units. The opposite ends of the external conductor are connected to the contact points of the respective light emitting units. At this time, from the viewpoint of workability, the respective light emitting units are electrically connected to one another by bending the external conductor or by using an external conductor differing in shape.

However, if the light emitting units are arranged in a mutually adjoining relationship, the contact points for electrically interconnecting the adjoining light emitting units are adjacent to each other. This imposes a restriction on the space for accommodation of the external conductor interconnecting the contact points. As a result, even if the external conductor is bent or the external conductor differing in shape is used in conformity with the arrangement of the light emitting units, it is sometimes the case that the workability grows worse due to the insufficient space. The arrangement of the light emitting units is restricted if an attempt is made to secure a sufficient space. It is therefore impossible to arrange the light emitting units with no gap left therebetween. This reduces the degree of freedom in arranging the light emitting units.

SUMMARY OF THE INVENTION

In view of the above, the present invention provides an illumination device capable of enhancing the workability when electrically connecting the illumination device to an external device and capable of reducing the restriction in arrangement generated during the connection and eventually increasing the degree of freedom in arrangement, and an illumination system using the same.

In accordance with an aspect of the present invention, there is provided an illumination device, including: a light source unit having a light emitting panel; and a mounting unit attached to a non-light-emission surface of the light source unit and provided with a circuit board for controlling energization of the light emitting panel, wherein the mounting unit includes a connection terminal to which an external conductor for electrically interconnecting the circuit board and an external device is connected, the connection terminal is arranged inward of an outer peripheral end of a surface of the mounting unit to which the light source unit is attached, a clearance for passing the external conductor therethrough is formed between the light source unit and the mounting unit in a state that the external conductor is connected to the connection terminal and the mounting unit is attached to the light source unit.

The connection terminal and the external conductor may be connected to each other by a connector of the connection terminal and a connector of the external conductor. The connector of the connection terminal may be arranged to face toward the outside of the mounting unit.

The connector of the connection terminal may be arranged to face the external device.

The connection terminal may include a power receiving portion for receiving electric power from the external device and a power transmitting portion for transmitting the electric power received by the power receiving portion to another external device.

The connection terminal may include a signal receiving portion for receiving a control signal from the external device and a signal transmitting portion for transmitting the control signal received by the signal receiving portion or a signal generated pursuant to the control signal to another external device.

The connection terminal may include a power receiving portion for receiving electric power from the external device, a signal receiving portion for receiving a control signal from the external device, a power transmitting portion for transmitting the electric power received by the power receiving portion to another external device and a signal transmitting portion for transmitting the control signal received by the signal receiving portion or a signal generated pursuant to the control signal to the another external device, the power receiving portion and the signal receiving portion being arranged to adjoin to each other, the power transmitting portion and the signal transmitting portion being arranged to adjoin to each other.

The device may further include a lead-wire wiring adjustment portion for guiding a flexible lead wire making up the external conductor and for adjusting a direction in which the lead wire is led out to the outside of the illumination device.

The device may further include a lead-wire wiring adjustment portion for guiding a flexible lead wire making up the external conductor and for adjusting a direction in which the lead wire is led out to the outside of the illumination device, wherein the lead-wire wiring adjustment portion includes a first guide for leading out the lead wire in a first direction toward which the connector of the connection terminal faces, a second guide for leading out the lead wire in a second direction orthogonal to the first direction and parallel to a surface of the mounting unit mounted to the light source unit, and a third guide for leading out the lead wire in a third direction opposite to the second direction.

An illumination system may include the illumination device described above.

In the present invention, the connection terminal, to which the external conductor is connected, is arrange inward of the outer peripheral end of the mounting unit. The clearance for passing the external conductor therethrough is formed between the light source unit and the mounting unit. Thus there is provided a space for accommodating the external conductor. Accordingly, even if an additional space is needed when the illumination device is electrically connected to the external device by, e.g., bending the external conductor or by using the external conductor differing in shape, it is possible to secure the additional space and to enhance the workability. In addition, it is possible to eliminate the restriction in arrangement in securing the space for accommodation of the external conductor. It is also possible to reduce the restriction in arrangement caused by the electric connection of the illumination device to the external device. This assists in increasing the degree of freedom in arrangement.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Figure 1:
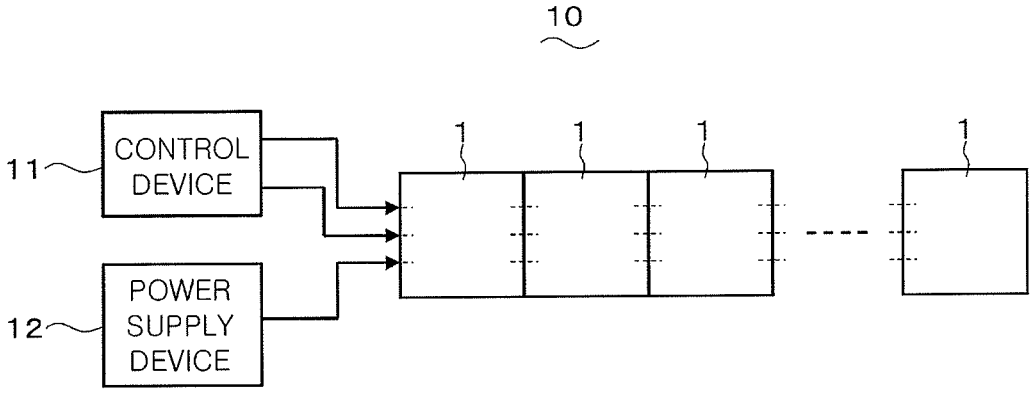
FIG. 1 is a block diagram showing an illumination system using an illumination device according to an embodiment of the present invention.

An illumination device according to an embodiment of the present invention and an illumination system using the same will now be described with reference to the accompanying drawings which form a part hereof. FIG. 1 shows the configuration of an illumination system including a plurality of illumination devices according to the present embodiment.

The illumination devices 1 according to the present embodiment are configured so that they can be electrically connected to one another. In the illumination system 10 shown in FIG. 1, the illumination devices 1 are arranged side by side in a row and are electrically connected to one another. The illumination system 10 further includes a control device 11 and a power supply device 12, both of which are electrically connected to one of the illumination devices 1 arranged at one end.

The control device 11 transmits a control signal for the control of the illumination devices 1 to the target illumination devices 1 through two transmission lines. The number of the transmission lines is not limited to two but may be one or more than two. The power supply device 12 supplies electric power for the operation of the illumination devices 1 to the target illumination devices 1. The control signal received, the signal generated pursuant to the control signal and the electric power supplied are sent from one of the illumination devices 1 to the next illumination device 1. In this manner, the signal and the electric power are transmitted in order.

Figure 2:
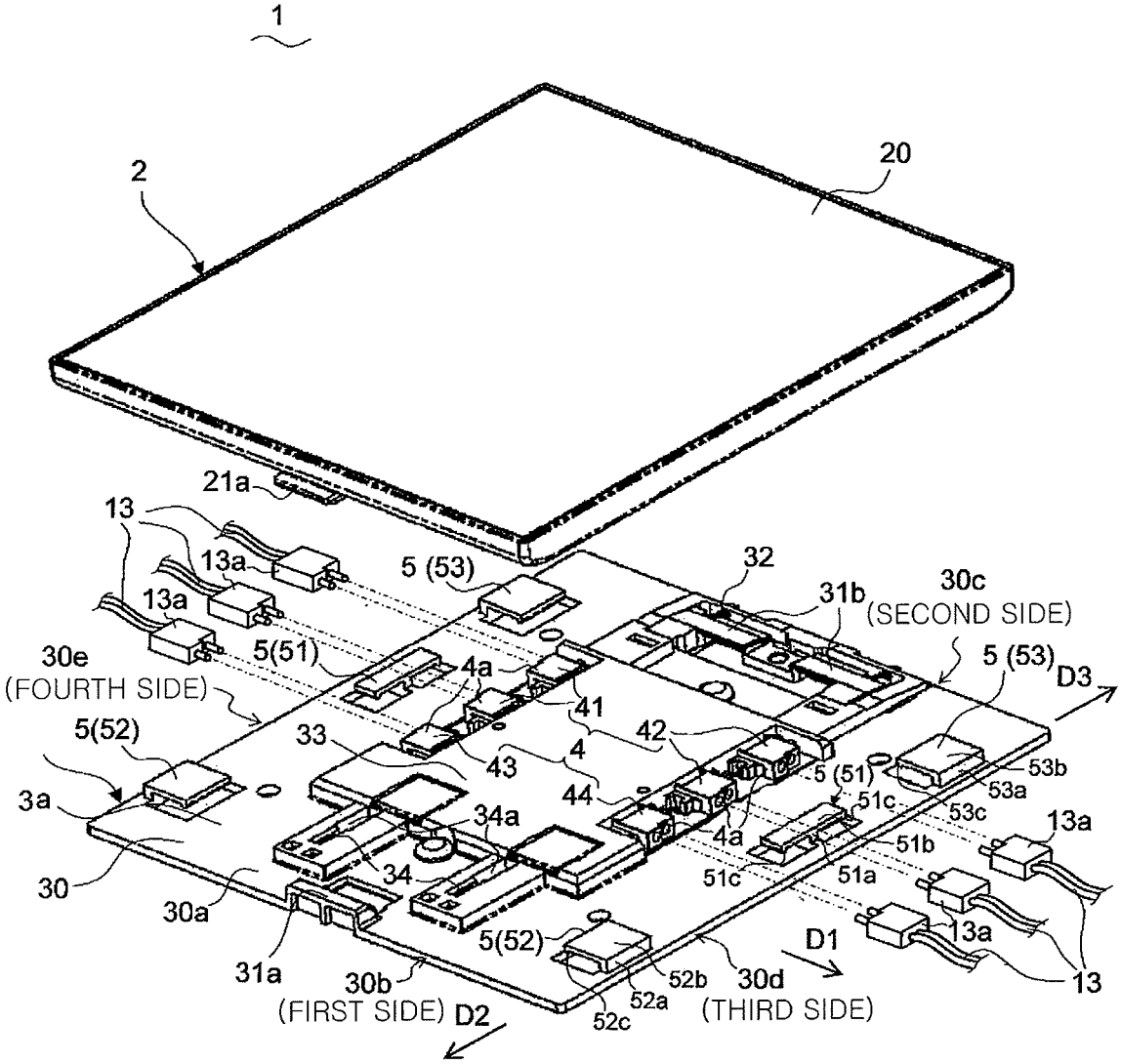
FIG. 2 is an exploded perspective view of the illumination device.

FIG. 2 shows the configuration of the illumination device 1. The illumination device 1 includes a light source unit 2 and a mounting unit 3 attached to the non-light-emitting surface of the light source unit 2. The mounting unit 3 is fixed to a mounting target such as a ceiling or a wall by means of a fastener such as a screw or a bolt. In this state, the light source unit 2 is attached to the mounting unit 3, whereby the light source unit 2 is held in the mounting target.

The light source unit 2 includes a package 20 for accommodating a flat light emitting panel formed of a solid light emitting element, e.g., an organic EL element. The mounting unit 3 includes a housing 30 removably attached to the package 20. The housing 30 accommodates a circuit board for controlling energization of the light emitting panel.

The mounting unit 3 includes connection terminals 4 to which are connected flexible lead wires (external conductors) 13 for electrically interconnecting the circuit board and the external device. The connection terminals 4 are arranged inward of the outer end portion of an attachment surface 3*a* of the mounting unit 3 to which the light source unit 2 is attached. The connection terminals 4 are electrically connected to the circuit board. A clearance for the passage of the lead wires 13 is formed between the light source unit 2 and the mounting unit 3 in a state that the lead wires 13 are connected to the connection terminals 4 and the mounting unit 3 is attached to the light source unit 2. Examples of the external device include the control device 11, the power supply device 12 or another illumination device 1.

The mounting unit 3 includes lead-wire wiring adjustment portions 5 for guiding the lead wires 13 and adjusting the direction in which the lead wires 13 are led out from the illumination device 1. The lead-wire wiring adjustment portions 5 are one-piece formed with the housing 30.

The package 20 and the housing 30 have a rectangular shape when seen in a plan view. One side of each of the package 20 and the housing 30 is a little larger than the other side thereof. A holding portion 21*a* is provided in the end portion of the package 20 extending along one of the four sides defining the non-light-emitting surface of the package 20. A held portion 31*a* held by the holding portion 21*a* is provided on the attachment surface 30*a* of the housing 30 to which the package 20 is attached. The attachment surface 30*a* is included in the attachment surface 3*a* of the mounting unit 3. The holding portion 21*a* is formed into a hook shape with the tip end thereof facing outward. The held portion 31*a* is formed into a shape capable of catching the tip end of the holding portion 21*a*.

A pair of engaging portions (not shown in FIG. 2) is provided in the end portion of the package 20 extending along the side of the package 20 opposite to the side along which the holding portion 21*a* extends. A pair of engaged portion 31*b* with which the engaging portions engage is provided on the attachment surface 30*a* of the housing 30. Just like the holding portion 21*a*, the engaging portions are formed into a hook shape with the tip ends thereof facing outward. The engaged portions 31*b* are formed into a shape capable of catching the tip ends of the engaging portions. The engaged portions 31*b* are connected to each other and are slidably attached to the housing 30. The engaged portions 31*b* are biased toward the inside the mounting unit 3 by biasing mechanisms 32 such as springs or the like.

The housing 30 includes a hollow circuit board reception portion 33 protruding from the substantially central area of the attachment surface 30*a* and a pair of slots 34*a* in which terminal reception portions 34 are embedded. Each of the terminal reception portions 34 is formed of a female terminal for electrically interconnecting the light source unit 2 and the circuit board. The circuit board reception portion 33 is configured to receive the circuit board. When the light source unit 2 is attached to the mounting unit 3, terminal portions are inserted into the slots 34*a*. The terminal portions are formed of male terminals protruding from the non-light-emission surface of the light source unit 2. Thus the terminal portions and the terminal reception portions 34 are connected to each other, whereby the circuit board and the light source unit 2 are electrically connected to each other.

For the sake of convenience in description, two mutually-opposing sides of the four sides defining the attachment surface 30*a* of the housing 30 will be called a first side 30*b* and a second side 30*c*, respectively. Two mutually-opposing sides orthogonal to the first side 30*b* and the second side 30*c* will be called a third side 30*d* and a fourth side 30*e*. The held portion 31*a* is arranged in the end portion of the housing 30 extending along the first side 30*b*. The engaged portions 31*b* are arranged in the end portion of the housing 30 extending along the second side 30*c*.

The connection terminals 4 are provided on the opposite side surfaces of the circuit board reception portion 33, namely on the side surface of the circuit board reception portion 33 existing near the third side 30*d* and the side surface of the circuit board reception portion 33 existing near the fourth side 30*e*. The connection terminals 4 and the lead wires 13 are provided with connectors 4*a* and 13*a*, respectively. The connection terminals 4 and the lead wires 13 are connected to each other by the connectors 4*a* and 13*a*. The connectors 4*a* and 13*a* are provided with insertion-type pin terminals. The pin terminals of the connectors 4*a* are of a female type and the pin terminals of the connectors 13*a* are of a male type. The pin terminals of the connectors 4*a* and 13*a* are configured so that they can be inserted and removed with respect to each other. The types of the pin terminals of the connectors 4*a* and 13*a* may be reversed. Each of the connectors 4*a* has a connection surface arranged to face toward the outside of the mounting unit 3. The protruding dimension of the circuit board reception portion 33 from the attachment surface 3*a* is set larger than the vertical dimension of the connectors 13*a*. The clearance formed between the light source unit 2 and the mounting unit 3 when the former is attached to the latter is large enough to define a space for accommodating at least the connectors 13*a*.

Each of the connection terminals 4 includes signal receiving portions 41 for receiving a control signal from the control device 11 (see FIG. 1) or another illumination device 1 and signal transmitting portions 42 for transmitting the control signal received by the signal receiving portions 41 or the signal generated pursuant to the control signal, to still another illumination device 1. Each of the connection terminals 4 further includes a power receiving portion 43 for receiving electric power from the power supply device 12 (see FIG. 1) or another illumination device 1 and a power transmitting portion 44 for transmitting the electric power received by the power receiving portion 43 to the same illumination device 1 as the illumination device 1 to which the signal is transmitted by the signal transmitting portion 42.

The signal receiving portions 41 and the signal transmitting portions 42 are provided in the number corresponding to the number of the transmission lines of the control device 11. Since the number of the transmission lines is two in the present embodiment, the signal receiving portions 41 and the signal transmitting portions 42 are two in number, respectively.

The signal receiving portions 41 and the power receiving portion 43 are arranged in a row in a mutually-adjoining relationship so that the surfaces of the connectors 4*a* connected to the connectors 13*a* can face toward the direction orthogonal to the fourth side 30*e*. In a state that another illumination device 1 as a control signal source or a power source is arranged adjacent to the fourth side 30*e*, the signal receiving portions 41 and the power receiving portion 43 are arranged in an opposing relationship with the another illumination device 1.

The signal transmitting portions 42 and the power transmitting portion 44 are arranged in a row in a mutually-adjoining relationship so that the surfaces of the connectors 4*a* connected to the connectors 13*a* can face toward the direction orthogonal to the third side 30*d*. In a state that still another illumination device 1 as a control signal destination or a power destination is arranged adjacent to the third side 30*d*, the signal transmitting portions 42 and the power transmitting portion 44 are arranged in an opposing relationship with the still another illumination device 1. The combination of the signal receiving portions 41 and the power receiving portion 43 and the combination of the signal transmitting portions 42 and the power transmitting portion 44 face toward the opposite direction from each other.

The lead-wire wiring adjustment portions 5 serve to guide the flexible lead wires 13 making up the external conductors and to adjust the direction in which the lead wires 13 are led out to the outside. Each of the lead-wire wiring adjustment portions 5 includes a first guide 51, a second guide 52 and a third guide 53. The first guide 51 is a guide for leading out the lead wires 13 in the first direction D1 toward which the connectors 4*a* face. The second guide 52 a guide for leading out the lead wires 13 in the second direction D2 orthogonal to the first direction D1 and parallel to the attachment surface 3*a*. The third guide 53 is a guide for leading out the lead wires 13 in the third direction D3 opposite to the second direction D2.

One set of the first guide 51, the second guide 52 and the third guide 53 is used to guide the lead wires 13 connected to the signal receiving portions 41 and the power receiving portion 43 and is provided along the fourth side 30*e*. Another set of the first guide 51, the second guide 52 and the third guide 53 is used to guide the lead wires 13 connected to the signal transmitting portions 42 and the power transmitting portion 44 and is provided along the third side 30*d*. These sets of the first guide 51, the second guide 52 and the third guide 53 are similar in configuration to each other.

Description will now be made on the set of the first guide 51, the second guide 52 and the third guide 53 provided along the third side 30*d*. The first guide 51 is arranged in the end portion of the housing 30 extending along the third side 30*d* and positioned in the area of the end portion opposing to the substantially central point of the row of the signal transmitting portions 42 and the power transmitting portion 44. The first guide 51 includes a support portion 51*a* installed upright on the attachment surface 30*a* of the housing 30 to extend along the first direction D1 and a wire pressing portion 51*b* joined to the top end of the support portion 51*a* and extending from the top end of the support portion 51*a* toward the opposite lateral sides of the housing 30. Thus the cross section of the first guide 51 orthogonal to the first direction D1 is formed into a substantially T-like shape. The first guide 51 further includes stoppers 51*c* formed at the tip ends of the wire pressing portion 51*b*. The stoppers 51*c* restrain movement of the lead wires 13 so that the lead wires 13 existing below the wire pressing portion 51*b* should not be removed from the spaces defined below the wire pressing portion 51*b*. The stoppers 51*c* are arranged at the tip ends of the wire pressing portion 51*b* to protrude toward the attachment surface 30*a* and to extend along the first direction D1.

The second guide 52 is arranged in the end portion of the housing 30 extending along the third side 30*d* and positioned in the end area deviated from the central area toward the second direction D2. The second guide 52 includes a support portion 52*a* installed upright on the attachment surface 30*a* of the housing 30 to extend along the second direction D2 and a wire pressing portion 52*b* joined to the top end of the support portion 52*a* and extending from the top end of the support portion 52*a* toward the inside of the housing 30. Thus the cross section of the second guide 52 orthogonal to the second direction D2 is formed into a shape of an alphabet L rotated 180 degrees clockwise. The second guide 52 further includes a stopper 52*c* formed at the tip end of the wire pressing portion 52*b*. The stopper 52*c* restrains movement of the lead wire 13 so that the lead wire 13 existing below the wire pressing portion 52*b* should not be removed from the space defined below the wire pressing portion 52*b*. The stopper 52*c* is arranged at the tip end of the wire pressing portion 52*b* to protrude toward the attachment surface 30*a* and to extend along the second direction D2.

The third guide 53 is arranged in the end portion of the housing 30 extending along the third side 30*d* and positioned in the end area deviated from the central area toward the third direction D3. The third guide 53 extends in the third direction D3. The shape of the third guide 53 is the same as the shape of the second guide 52.

When the illumination device 1 is in use, the mounting unit 3 is mounted to a mounting target. Then, the lead wires 13 are connected to the connection terminals 4. Thereafter, the light source unit 2 is attached to the mounting unit 3. The task of mounting the mounting unit 3 to the mounting target and the task of connecting the lead wires 13 to the connection terminals 4 may be performed in the reverse order.

Figure 3:
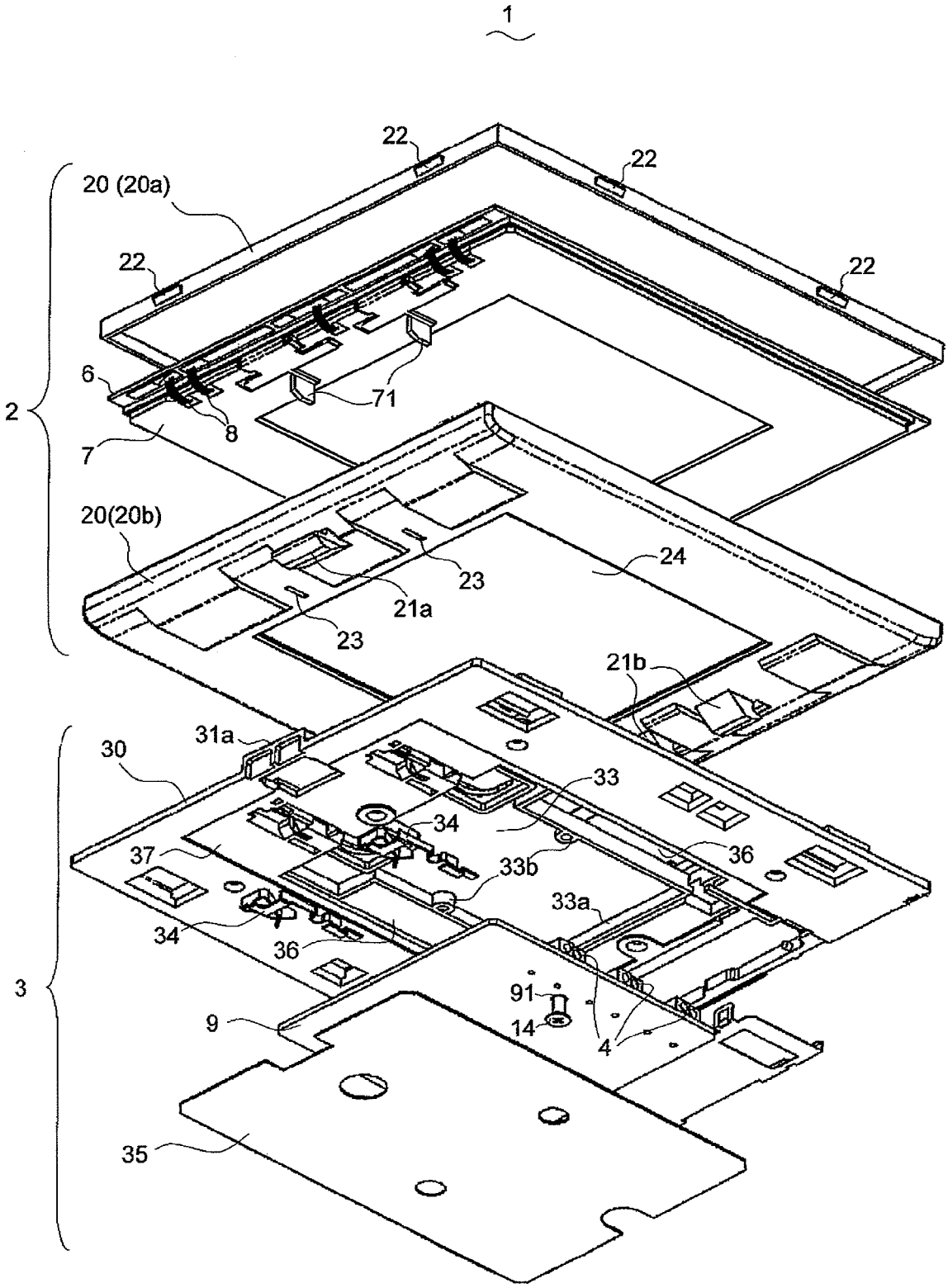
FIG. 3 is an exploded perspective view showing a light source unit and a mounting unit of the illumination device.

FIG. 3 shows the internal configuration of the light source unit 2 and the mounting unit 3. The light source unit 2 includes not only the package 20 but also a light emitting panel 6 and a wiring substrate 7. The wiring substrate 7 is arranged on the non-light-emission surface (the upper surface in FIG. 3) of the light emitting panel 6 and is accommodated within the package 20.

The light emitting panel 6 and the wiring substrate 7 are adhesively fixed to each other by a core-inserted acrylic double-side adhesive tape which is superior in heat resistance, humidity resistance and stress-relieving property. The light emitting panel 6 and the wiring substrate 7 are electrically connected to each other by lead wires 8 which is, e.g., ultrasonically-welded.

The light emitting panel 6 includes a rectangular light-transmitting base plate and a light emitting portion (not shown) formed by laminating a positive electrode made of a transparent conductive film, a light emitting layer having a light emitting function and a negative electrode having a light reflecting property on the base plate one above another. The light emitting portion is encapsulated by an encapsulating material.

The wiring substrate 7 is formed into a frame-like shape with a central opening. Terminal portions 71 to be inserted into the terminal reception portions 34 (see FIG. 1) of the mounting unit 3 protrude from the surface of the wiring substrate 7 facing the mounting unit 3. The terminal portions 71 are used to electrically interconnect the wiring substrate 7 and the mounting unit 3. The wiring substrate 7 is made of a base material having both high flame resistance and low electric conductivity, such as a glass fiber panel formed by impregnating a glass fiber fabric with an epoxy resin and then curing the epoxy resin (e.g., FR-4).

The package 20 includes a cover 20*a* for covering the light emission surface (the upper surface in FIG. 3) of the light emitting panel 6 and a case 20*b* for covering the non-light-emission surface of the light emitting panel 6. The cover 20*a* and the case 20*b* are fitted and locked to each other.

The cover 20*a* is formed of a rectangular transparent flat plate member. The cover 20*a* may be a frame-like member having an open surface facing the light emitting panel 6 or may be a plate member having at least a transparent surface facing the light emitting panel 6. If the cover 20*a* is the frame-like member, it is preferred that a transparent protection cover be arranged on the open surface. A plurality of fitting claws 22 for bringing the cover 20*a* and the case 20*b* into engagement with each other protrudes from the peripheral edge portion of the cover 20*a*.

The case 20*b* is a box-shaped member having an open surface facing the cover 20*a*. The opening of the case 20*b* corresponds in shape to the cover 20*a*. The cover 20*a* is inserted into the opening of the case 20*b*. Consequently, the fitting claws 22 are fitted to the fitting grooves (not shown) formed on the inner side surface of the case 20*b*, whereby the cover 20*a* and the case 20*b* are combined together. Slits 23 for exposing the terminal portions 71 toward the mounting unit 3 are formed in the case 20*b*. The terminal portions 71 are inserted through the slits 23. The bottom surface of the case 20*b* is formed into a shape corresponding to the shape of the wiring substrate 7. More specifically, a recess portion 24 is formed in the area of the outer bottom surface of the case 20*b* corresponding to the central opening of the wiring substrate 7. The area in which the recess portion 24 is formed is slightly raised upward.

The cover 20*a* and the case 20*b* may have an arbitrary shape depending on the use of the illumination device 1. The cover 20*a* and the case 20*b* may be formed into a shape corresponding to the shape of the light emitting panel 6. In the present embodiment, the cover 20*a* and the case 20*b* have a rectangular shape when seen in a plan view. The cover 20*a* is made of a transparent plastic material, e.g., an ABS resin, an acryl resin or a polystyrene resin. The case 20*b* is made of the same material as the material of the cover 20*a*. Alternatively, the case 20*b* may be made of an opaque material, e.g., a metallic material such as aluminum whose surface is subjected to an insulating treatment.

The mounting unit 3 includes not only the housing 30 and the circuit board 9 but also an insulating plate 35 for covering the opposite surface of the circuit board 9 from the light source unit 2 in a state that the circuit board 9 is accommodated within the circuit board reception portion 33 of the housing 30. The insulating plate 35 serves to protect the circuit board 9 so that the circuit board 9 should not be physically and electrically affected by the external environment.

The circuit board 9 is made of the same material as the base material of the wiring substrate 7. The connection terminals 4 and various kinds of elements such as a driver for driving the light emitting panel 6 are mounted on the surface of circuit board 9 facing the light source unit 2. The various kinds of the elements are arranged in the central area of the circuit board 9. The connection terminals 4 are arranged in the end portions of the circuit board 9. The circuit board 9 is accommodated into the circuit board reception portion 33 at the opposite side from the light source unit 2.

The housing 30 includes cutout portions 36 formed in the positions corresponding to the connection terminals 4. When the circuit board 9 is attached to the housing 30, the cutout portions 36 expose the connection terminals 4 to the side of the light source unit 2, and the circuit board reception portion 33 accommodates the various kinds of elements. A holding frame 33*a* is formed in the peripheral edge of the circuit board reception portion 33. Screw fixing portions 33*b* for fixing the circuit board 9 with screws are provided on the inner wall of the holding frame 33*a*. The holding frame 33*a* and the screw fixing portions 33*b* keep the circuit board 9 in a half-floating state so that the various kinds of elements mounted on the circuit board 9 should not make contact with the bottom surface of the circuit board reception portion 33. The circuit board 9 has screw holes 91 formed in the positions corresponding to the screw fixing portions 33*b*. The circuit board 9 is attached to the housing 30 by inserting screws 14 through the screw holes 91 and fixing the screws 14 to the screw fixing portions 33*b*. The circuit board reception portion 33 is arranged in such a position where the top portion of the circuit board reception portion 33 is fitted to the recess portion 24 of the case 20*b* when the mounting unit 3 is attached to the light source unit 2.

The housing 30 includes an insulating plate reception portion 37 formed on the opposite surface of the housing 30 from the light source unit 2. The insulating plate 35 is fitted to the insulating plate reception portion 37. The insulating plate reception portion 37 corresponds in shape to the insulating plate 35. The depth of the insulating plate reception portion 37 is substantially equal to the thickness of the insulating plate 35. The circuit board reception portion 33 is further depressed from the insulating plate reception portion 37. The dimension of the holding frame 33*a* is adjusted in advance so that the opposite surface of the circuit board 9 from the mounting surface can be substantially flush with the bottom surface of the insulating plate reception portion 37 when the circuit board 9 is attached to the housing 30. Due to this dimension adjustment, little step difference exists between the bottom surface of the housing 30 and the bottom surface of the insulating plate 35 when the insulating plate 35 is fitted to the insulating plate reception portion 37. Accordingly, if the housing 30 is attached so that the bottom surface thereof can make contact with a mounting target, the housing 30 is not loosened and is stably mounted.

Figure 4:
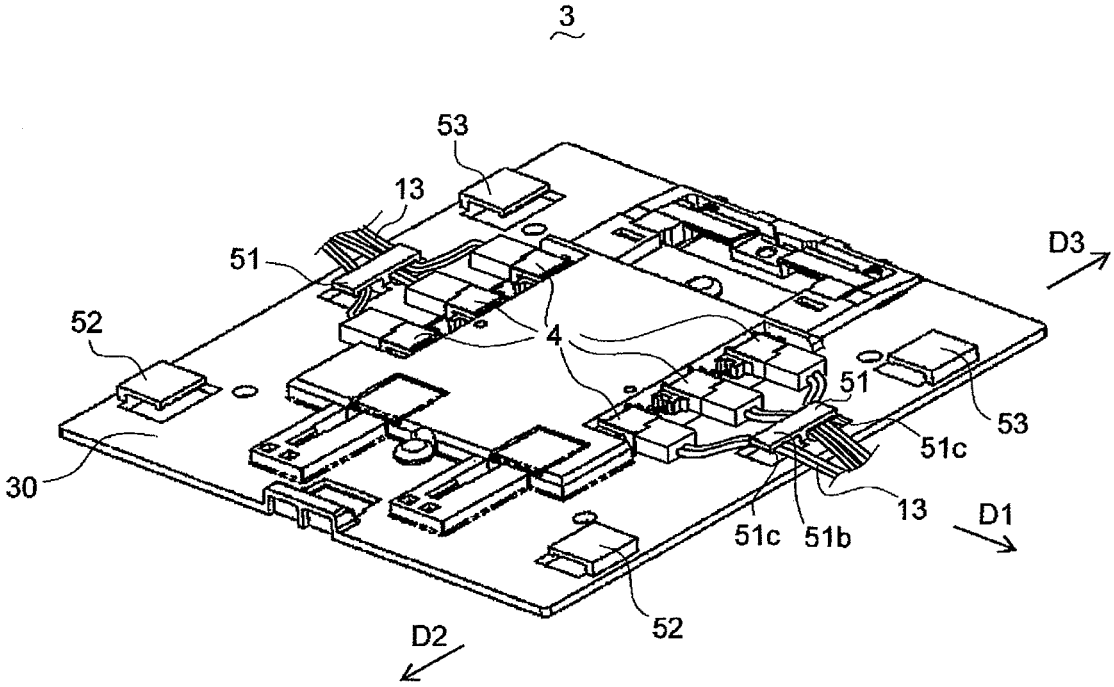
FIG. 4 is a perspective view showing one wiring example in the mounting unit.

FIG. 4 shows one wiring example of the lead wires 13 in a state that the lead wires 13 are connected to the connection terminals 4. In the present wiring example, the lead wires 13 are guided by the first guide 51. This wiring is carried out, e.g., when an external device is arranged in the first direction D1. The lead wires 13 are appropriately bent and are gathered in the lower spaces of the wire pressing portion 51*b*. The restoring motion of the lead wires 13 is restrained by the stoppers 51*c* so that the lead wires 13 should not be removed from the lower spaces due to the restoring force of the lead wires 13 kept in a bent state. In this manner, the lead wires 13 are held so that they can be led out in the first direction D1.

Figure 5:
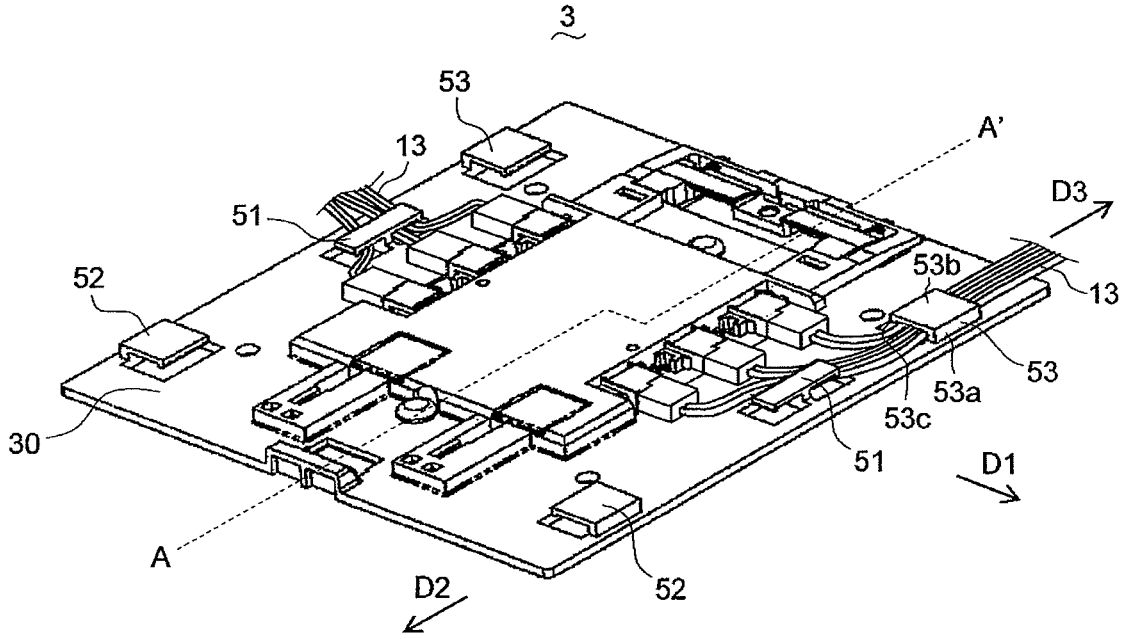
FIG. 5 is a perspective view showing another wiring example in the mounting unit.

FIG. 5 shows another wiring example of the lead wires 13. In this wiring example, the lead wires 13 extending from the signal transmitting portions 42 and the power transmitting portion 44 are guided by the third guide 53. This wiring is carried out, e.g., when an external device as a power and signal destination is arranged in the third direction D3. The lead wires 13 are bent substantially at a right angle from the first direction D1 toward the third direction D3 and are gathered in the lower surface of the wire pressing portion 53*b*. The restoration of the lead wires 13 from the bent state is restrained by the support portion 53*a*. The movement of the lead wires 13 is restrained by the stopper 53*c* so that the lead wires 13 should not be removed from the lower space toward the inside of the housing 30. In this manner, the lead wires 13 are held so that they can be led out in the third direction D3. While not shown in the drawings, the wiring adjustment of the lead wires 13 using the second guide 52 can be performed in the same manner as the wiring adjustment using the third guide 53.

Figure 6A:
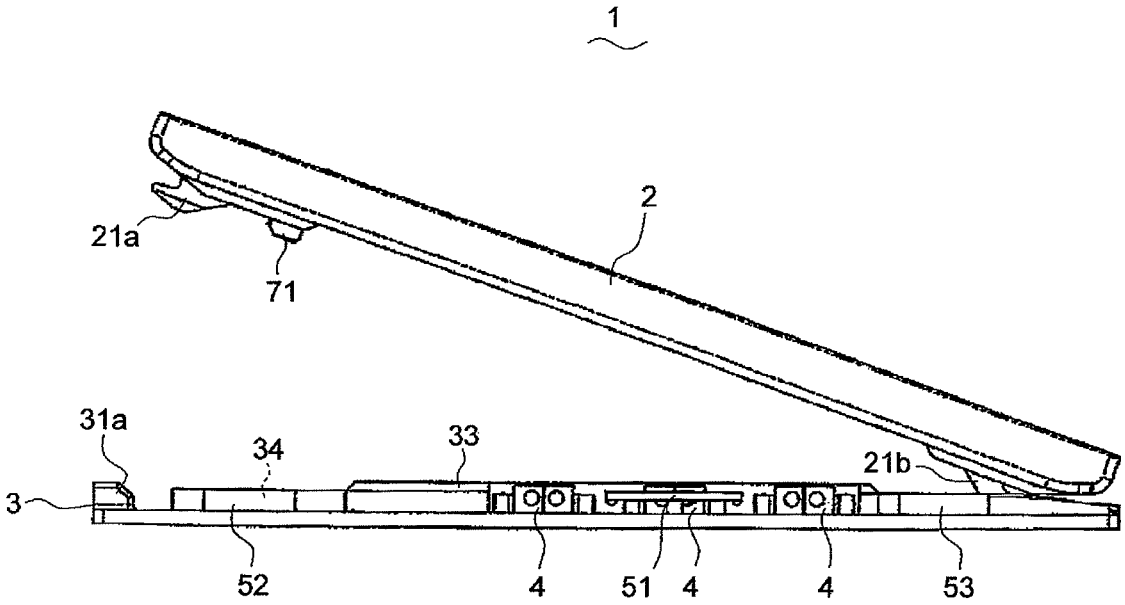
FIG. 6A is a side view of the illumination device under an attachment process in which the light source unit is attached to the mounting unit.
Figure 6B:
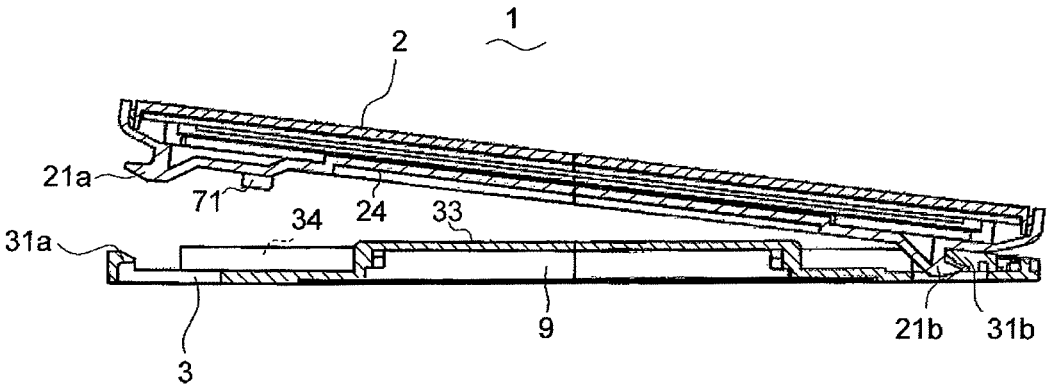
FIG. 6B is a section view of the illumination device under the attachment process, in which view the mounting unit is taken along line A-A' in FIG. 5 and the light source unit is taken along a line corresponding to line A-A'.

FIGS. 6A to 7B illustrate the order of attaching the light source unit 2 to the mounting unit 3. The mounting unit 3 is fixed in advance to a mounting target such as a ceiling or a wall. The lead wires 13 (not shown in FIGS. 6A to 7B) are connected to the connection terminals 4. As illustrated in FIGS. 6A and 6B, the light source unit 2 is arranged so that the terminal portions 71 and the terminal reception portions 34 can face each other. Thereafter, the light source unit 2 is tilted and the engaging portions 21*b* are inserted into the engaged portions 31*b*. Then, if the light source unit 2 is rotated about the engagement position of the engaging portions 21*b* and the engaged portions 31*b* so that the light source unit 2 can move toward the mounting unit 3, the light source unit 2 and the mounting unit 3 are brought into a parallel positional relationship. The terminal portions 71 are inserted into the slots 34*a* (see FIG. 2). During the rotation of the light source unit 2, the engaged portions 31*b* are pushed by the engaging portions 21*b*, whereby the engaged portions 31*b* are slid outward.

Figure 7A:
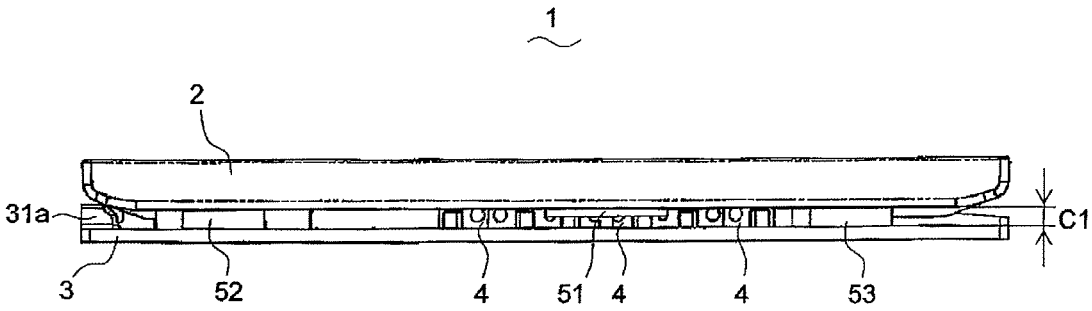
FIG. 7A is a side view of the illumination device after attachment of the light source unit to the mounting unit.
Figure 7B:
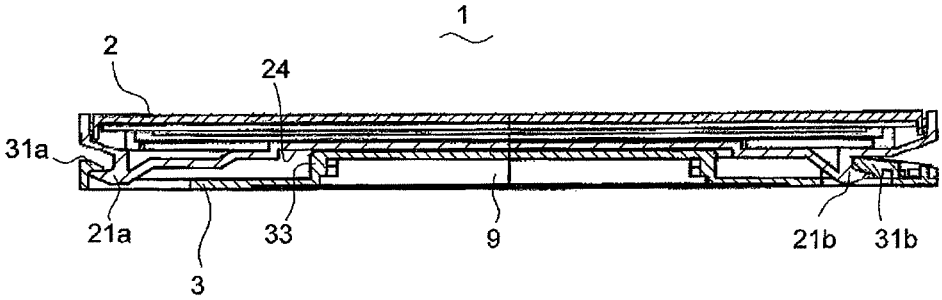
FIG. 7B is a section view of the illumination device after attachment of the light source unit to the mounting unit, in which view the mounting unit is taken along line A-A' in FIG. 5 and the light source unit is taken along a line corresponding to line A-A'.

If the engaged portions 31*b* are slid inward by the biasing mechanism 32 (see FIG. 2) in a state that the light source unit 2 and the mounting unit 3 are kept parallel to each other as illustrated in FIGS. 7A and 7B, the light source unit 2 is slid and the holding portion 21*a* is held in the held portion 31*a*. In this regard, the engaged portions 31*b* are biased inward by the biasing mechanism 32. Therefore, if a worker relaxes the pushing force applied to the engaged portions 31*b* by the engaging portions 21*b*, the light source unit 2 is slid automatically and the holding portion 21*a* is held by the held portion 31*a*. At this time, a resilient force is applied by the biasing mechanism 32. This makes it possible to improve the mounting sense felt by a worker. In this mounting process, the terminal portions 71 are connected to the terminal reception portions 34 (see FIGS. 6A and 6B), thereby simultaneously performing the mechanical coupling and the electric connection of the light source unit 2 and the mounting unit 3. As a consequence, the process of mounting the light source unit 2 to the mounting unit 3 is finished.

When the mounting process is finished, the light source unit 2 is placed on the circuit board reception portion 33, whereby a clearance C1 is formed between the light source unit 2 and the mounting unit 3. The clearance C1 is used to pass the lead wires 13 (see FIG. 2) therethrough. The clearance C1 accommodates the connectors 13*a* (see FIG. 2) and other components.

When removing the light source unit 2 from the mounting unit 3, the light source unit 2 is gripped and pushed into the engaged portions 31*b*. Thus the engaged portions 31*b* make sliding movement. As a result, the light source unit 2 is also slid a little bit. The holding portion 21*a* is removed from the held portion 31*a* and is not held by the held portion 31*a*. If the end portion of light source unit 2 not held by the held portion 31*a* is lifted up and detached from the mounting unit 3, it is possible to easily remove the light source unit 2 from the mounting unit 3. If a plurality of illumination devices 1 is arranged in a row, the engaged portions 31*b* are slid by use of a worker's finger. If a plurality of illumination devices 1 is arranged in a matrix pattern, the engaged portions 31*b* are slid by inserting a rod-shaped member into the clearance between the illumination devices 1. As a consequence, the light source unit 2 is slid a little bit. The holding portion 21*a* is removed from the held portion 31*a* and is not held by the held portion 31*a*. Thus the light source unit 2 can be removed from the mounting unit 3.

In the present embodiment, the connection terminals 4, to which the lead wires 13 are connected, are arrange inward of the outer peripheral end of the mounting unit 3. The clearance C1 for passing the lead wires 13 therethrough is formed between the light source unit 2 and the mounting unit 3. Thus there is provided a space for accommodating the lead wires 13. Accordingly, even if an additional space is needed when the illumination device 1 is electrically connected to an external device by, e.g., bending the lead wires 13 or by using the lead wires 13 differing in shape, it is possible to secure the additional space and to enhance the workability. In addition, it is possible to eliminate the restriction in arrangement in securing the space for accommodation of the lead wires 13. For example, the illumination device 1 can be arranged adjacent to an external device with no gap left between the illumination device 1 and the external device. Thanks to this feature, it is possible to reduce the restriction in arrangement caused by the electric connection of the illumination device 1 to the external device. This makes it possible to increase the degree of freedom in arrangement. The connection terminals 4 are covered by the light source unit 2 when the light source unit 2 is attached to the mounting unit 3. Thus the connection terminals 4 are not visible from the front side of the light source unit 2. This assists in improving the external appearance of the illumination device 1. It is also possible for the light source unit 2 to protect the connection terminals 4 from the external environment.

The connectors 4*a* of the connection terminals 4 face toward the outside of the mounting unit 3. This makes it easy to connect the connectors 13*a* of the lead wires 13 to the connectors 4*a* at the outside of the mounting unit 3. Thus the task of connecting the connectors 13*a* to the connectors 4*a* becomes easier. When another illumination device 1 is arranged to make contact with the third side 30*d* or the fourth side 30*e*, the length of the lead wires 13 for electrically interconnecting the connectors 4*a* and the another illumination device 1 can be shortened because the connectors 4*a* face toward the another illumination device 1. Accordingly, it is possible to simplify the wiring of the lead wires 13 and to reduce the costs of the lead wires 13.

In the event that an external device is connected to the power receiving portion 43 and another external device is connected to the power transmitting portion 44, the illumination device 1 can receive electric power from the external device through the power receiving portion 43 and can transmit the electric power to the another external device through the power transmitting portion 44. This makes it possible to deliver the electric power. In case where an external device is connected to the signal receiving portions 41 and additional external device is connected to the signal transmitting portions 42, the illumination device 1 can receive a control signal from the external device through the signal receiving portions 41 and can transmit the received control signal or the signal generated pursuant to the control signal to the another external device through the signal transmitting portions 42. This makes it possible to deliver the signal.

If the external device to be connected is common to the signal receiving portions 41 and the power receiving portion 43, it is possible to reduce the time required in connecting the external device to the signal receiving portions 41 and the power receiving portion 43 through the lead wires 13. This is because the signal receiving portions 41 and the power receiving portion 43 are positioned adjacent to each other.

The same effect can be obtained when connecting the lead wires 13 to the signal transmitting portions 42 and the power transmitting portion 44. The combination of the signal receiving portions 41 and the power receiving portion 43 and the combination of the signal transmitting portions 42 and the power transmitting portion 44 face toward the opposite direction from each other. Therefore, if the external device as a power and signal source, the illumination device 1 and the external device as a power and signal destination are arranged side by side in a row in the order of transmission of the electric power and the signal, it is possible to shorten the length of the lead wires 13 arranged between the respective external devices and the illumination device 1.

The wiring of the lead wires 13 can be simplified by guiding the lead wires 13 with the lead-wire wiring adjustment portions 5. The first guide 51, the second guide 52 and the third guide 53 are arranged to lead out the lead wires 13 in the first direction D1, the second direction D2 and the third direction D3, respectively. When seen from the front side of the mounting unit 3, the first direction D1, the second direction D2 and the third direction D3 designate the upper side, the lateral side and the lower side, respectively. Regardless of whether the external device is arranged in any one of the upper side, the lateral side and the lower side of the mounting unit 3, it is therefore possible to lead out the lead wires 13 toward the external device using one of the first guide 51, the second guide 52 and the third guide 53. This makes it possible to simplify the wiring of the lead wires 13.

The present invention is not limited to the configuration of the foregoing embodiment but may be modified in many different forms depending on the intended use.

While the invention has been shown and described with respect to the embodiments, the present invention is not limited thereto. It will be understood by those skilled in the art that various changes and modifications may be made without departing from the scope of the invention as defined in the following claims.

What is claimed is:

1. An illumination device, comprising: a light source unit having a light emitting panel; and a mounting unit attached to a non-light-emission surface of the light source unit, wherein the mounting unit includes a circuit board for controlling energization of the light emitting panel and a housing having a circuit board reception portion receiving the circuit board, and an attachment surface to attach to the non-light-emission surface of the light source unit, the circuit board includes a connection terminal configured to be connected to an external conductor for electrically interconnecting the circuit board and an external device, the connection terminal is arranged inward of an outer peripheral end of the attachment surface, the circuit board reception portion protrudes from the attachment surface toward the light source unit and a protruding dimension of the circuit board reception portion from the attachment surface is greater than a dimension of the external conductor along a protruding direction of the circuit board reception portion, and a clearance is provided between the non-light-emission surface of the light source unit and the attachment surface of the mounting unit to provide a space for accommodating the external conductor in a state that the external conductor is connected to the connection terminal and the mounting unit is attached to the light source unit.

2. The device of claim 1, wherein the connection terminal and the external conductor are connected to each other by a connector of the connection terminal and a connector of the external conductor, the connector of the connection terminal being arranged to face toward the outside of the mounting unit.

3. The device of claim 2, wherein the connector of the connection terminal is arranged to face the external device.

4. The device of claim 3, wherein the connection terminal includes a power receiving portion for receiving electric power from the external device, a signal receiving portion for receiving a control signal from the external device, a power transmitting portion for transmitting the electric power received by the power receiving portion to another external device and a signal transmitting portion for transmitting the control signal received by the signal receiving portion or a signal generated pursuant to the control signal to the another external device, the power receiving portion and the signal receiving portion being arranged to adjoin to each other, the power transmitting portion and the signal transmitting portion being arranged to adjoin to each other.

5. The device of claim 3, further comprising:

a lead-wire wiring adjustment portion for guiding a flexible lead wire making up the external conductor and for adjusting a direction in which the lead wire is led out to the outside of the illumination device, wherein the lead-wire wiring adjustment portion includes a first guide for leading out the lead wire in a first direction toward which the connector of the connection terminal faces, a second guide for leading out the lead wire in a second direction orthogonal to the first direction and parallel to a surface of the mounting unit mounted to the light source unit, and a third guide for leading out the lead wire in a third direction opposite to the second direction.

6. The device of claim 2, further comprising:

a lead-wire wiring adjustment portion for guiding a flexible lead wire making up the external conductor and for adjusting a direction in which the lead wire is led out to the outside of the illumination device, wherein the lead-wire wiring adjustment portion includes a first guide for leading out the lead wire in a first direction toward which the connector of the connection terminal faces, a second guide for leading out the lead wire in a second direction orthogonal to the first direction and parallel to a surface of the mounting unit mounted to the light source unit, and a third guide for leading out the lead wire in a third direction opposite to the second direction.

7. The device of claim 1, wherein the connection terminal includes a power receiving portion for receiving electric power from the external device and a power transmitting portion for transmitting the electric power received by the power receiving portion to another external device.

8. The device of claim 1, wherein the connection terminal includes a signal receiving portion for receiving a control signal from the external device and a signal transmitting portion for transmitting the control signal received by the signal receiving portion or a signal generated pursuant to the control signal to another external device.

9. The device of claim 1, further comprising:

a lead-wire wiring adjustment portion for guiding a flexible lead wire making up the external conductor and for adjusting a direction in which the lead wire is led out to the outside of the illumination device.

10. An illumination system comprising the illumination device of claim 1.

11. The illumination device according to claim 1, the attachment surface comprising a planar surface of said housing.

12. The illumination device according to claim 1, the circuit board comprising a generally planar member, the circuit board reception portion comprising an aperture in the housing, the circuit board being received within the circuit board reception portion such that the circuit board extends in a plane generally parallel to the plane of the light emitting panel.

13. The illumination device according to claim 1, each of the housing and the circuit board comprising a generally planar member, the circuit board being received within the circuit board reception portion and extending in a plane generally parallel to the plane of the housing.

14. The illumination device according to claim 1, wherein the light emitting panel comprises an active light emitting panel as a light source.

* * * * *